US006119308A

United States Patent [19]

Owen

[11] Patent Number: 6,119,308

[45] Date of Patent: Sep. 19, 2000

[54] VERTICAL BLIND EXTRUDED TRACK AND TILT ROD MEMBERS

[75] Inventor: Evan D. Owen, Concord, N.C.

[73] Assignee: Eastern Metal Supply of N.C., Inc., Charlotte, N.C.

[21] Appl. No.: 09/184,188

[22] Filed: Mar. 18, 1998

[51] Int. Cl.[7] ..... B21C 23/00

[52] U.S. Cl. ..... 16/87 R; 264/177.1; 72/254

[58] Field of Search ..... 72/254, 255, 261; 264/173.17, 177.1; 160/166.1 R, 405, 900; 16/87 R

[56] References Cited

U.S. PATENT DOCUMENTS

| | | | |
|---|---|---|---|
| 3,321,950 | 5/1967 | Gettig | 72/255 |
| 4,193,438 | 3/1980 | Pastore | 160/166 A |
| 4,203,311 | 5/1980 | O'Connor et al. | 72/254 |
| 4,981,637 | 1/1991 | Hyer | 264/177.1 |
| 5,042,553 | 8/1991 | Schaffer | 160/178.1 |
| 5,105,870 | 4/1992 | Merjane | 160/236 |
| 5,204,035 | 4/1993 | Boltze et al. | 264/177.1 |
| 5,394,649 | 3/1995 | Lindgren et al. | 49/381 |
| 5,462,707 | 10/1995 | Nagy | 264/177.1 |
| 5,667,178 | 9/1997 | Yang | 248/262 |

FOREIGN PATENT DOCUMENTS

| | | | |
|---|---|---|---|
| 0255216 | 12/1985 | Japan | 72/254 |
| 0282724 | 12/1987 | Japan | 72/254 |
| 404066215 | 3/1992 | Japan | 72/254 |
| 405104133 | 4/1993 | Japan | 72/254 |

*Primary Examiner*—Anthony Knight
*Assistant Examiner*—Mark Williams
*Attorney, Agent, or Firm*—Dann Dorfman Herrell & Skillman

[57] ABSTRACT

An extruded component for vertical blinds comprises an track and tilt rod that are extruded as one piece. An bridge attaches the tilt rod internally inside the track. When the user desires to fabricate the vertical blinds, the tilt rod is cut from the track at the bridge and the vertical blinds are assembled.

34 Claims, 2 Drawing Sheets

VERTICAL BLIND EXTRUDED TRACK AND TILT ROD MEMBERS

FIELD OF THE INVENTION

The present invention relates to extruded tracks and tilt rods used for fabricating and operating vertical blinds. More specifically, the invention relates to tracks and tilt rods that are extruded as one piece during manufacture and separated before fabrication using a special tool.

BACKGROUND OF THE INVENTION

Various types of tracks and tilt rods are extruded for the fabrication and operation of vertical blinds. Vertical blinds utilize tracks and rods to open and close vertical vanes. Traditionally, these two components have been extruded as separate shapes. They end up being manufactured, packaged, shipped and stocked as separate components.

Since these components are manufactured separately, many problems arise in the industry. Examples of problems that may arise from extruding the tracks and tilt rods separately include: inconsistent quality for both products; varying lead times from different suppliers; different packaging parameters for the track and tilt rod; inconsistent pricing from various track and tilt rod manufacturers; inventory requirements to stock separate inventories for both products; and freight damages due to odd bundle sizes and inconsistent packaging. Therefore, it has become desirable to extrude the track and tilt rod as one component and separate the two when the user desires to fabricate the vertical blinds. This will enable the manufacturer to produce, package, ship, and stock the components together and, as a result, reduce cost and increase quality.

SUMMARY OF THE INVENTION

An extruded component for vertical blinds comprises an track and tilt rod that are extruded as one piece. A bridge attaches the tilt rod internally inside the track. The tilt rod is separated from the track when the user desires to fabricate the vertical blinds. The tilt rod is cut from the track at the bridge with a custom designed tool before assembly. By extruding the track and tilt rod as one component, it ensures that one manufacturer will produce both pieces. This prevents two different manufacturers from having to produce, package, ship, and stock the components separately. This reduces the likelihood of problems arising when different manufacturers produce parts for the same product. The result is reduced cost and increased quality.

DETAILED DESCRIPTION OF THE INVENTION

Figure 1:
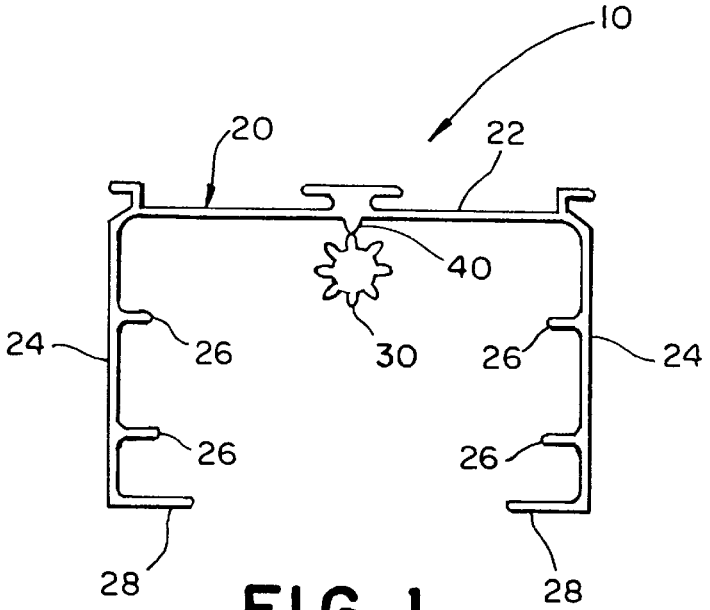
FIG. 1 is a cross-sectional view of an extruded track and star shaped tilt rod.

Referring to the drawings in general, there is illustrated an extruded track and tilt rod assembly 10 used for operating vertical blinds. The track 20 and tilt rod 30 are extruded together as one piece. The components will be separated when the vertical blinds are to be fabricated. A custom designed tool is utilized to cut the tilt rod 30 from the track 20 before final assembly of the vertical blinds. The extrusion of the track 20 and tilt rod 30 as one piece that are separable enables the manufacturer to produce, package, ship, and stock the components together. This results in reduced cost and increased quality.

Referring to FIG. 1, there is illustrated an extruded track and tilt rod assembly designated generally 10. The track 20 is U-shaped and has a base portion 22. Walls 24 are transverse to the base portion 22 and extend outwardly from each end of the base portion 22. Two short legs 26 project inwardly toward the inside of the track from each of the walls 24 when fabricated in a vertical blind assembly. The legs 26 house a carrier (not shown) which rotates the vanes of the vertical blinds hanging from each carrier. Flanges 28 extend inward toward the inside of the track from the free ends of the walls 24. The flanges 28 project inwardly toward the open end of the U-shaped track 20, but do not touch one another. The flanges 28 are slightly longer than the legs 26 that house the carriers and are designed this way for an aesthetically pleasing effect.

The combination of the base portion 22, two walls 24, four legs 26, and two flanges 28 comprise the track 20. The track 20 is mounted horizontally on walls, ceilings, doors, or window sills using clips that are known to the vertical blind industry.

Figure 2:
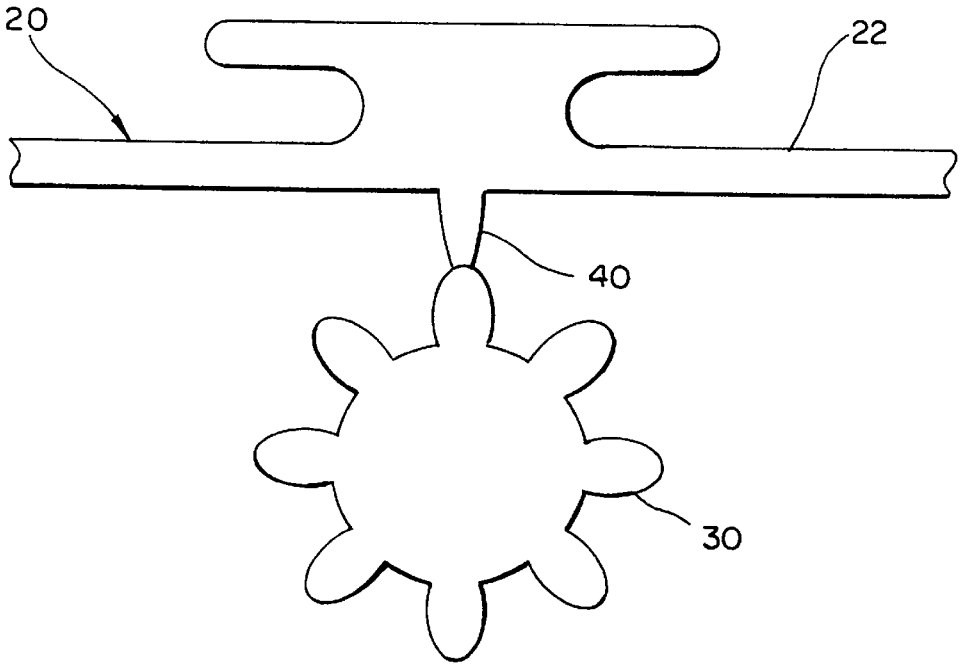
FIG. 2 is an enlarged fragmentary view of the device illustrated in FIG. 1, showing the bridge attaching the extruded track and star shaped tilt rod.
Figure 3:
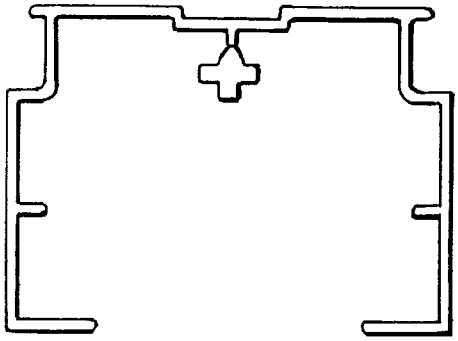
FIG. 3 is a cross-sectional view of an alternative embodiment of an extruded track and tilt rod of different configurations.
Figure 4:
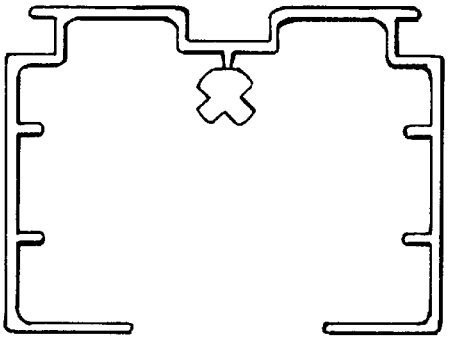
FIG. 4 is a cross-sectional view of a second alternative embodiment of an extruded track and tilt rod of different configurations.
Figure 5:
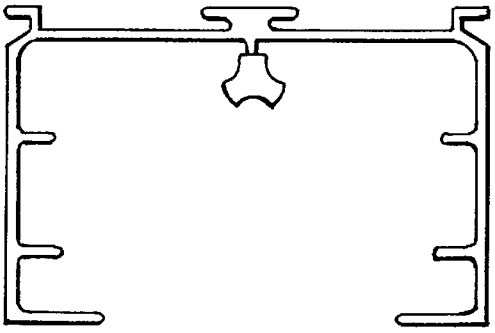
FIG. 5 is a cross-sectional view of a third alternative embodiment of an extruded track and tilt rod of different configurations.
Figure 6:
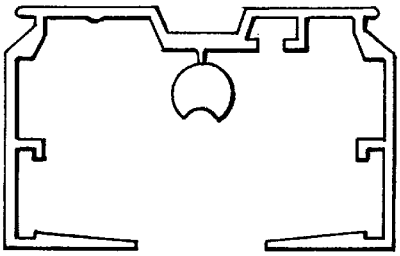
FIG. 6 is a cross-sectional view of a fourth alternative embodiment of an extruded track and tilt rod of different configurations.

As shown best in FIG. 2, a bridge 40 extends vertically towards the open end of the U-shaped track 20 in the present instance, generally parallel to the walls 24. The track 20, bridge 40, and tilt rod 30 are all extruded as one solid piece. The bridge 40 attaches the tilt rod 30 to the track 20 during the extrusion process. Thus, the tilt rod 30 is located internally inside the track 20. When the user desires to fabricate the vertical blinds, the two components are separated.

In order to separate the two components, the tilt rod 30 is cut from the track 20 using a custom designed tool. The bridge 40 is extruded and arranged to be severed to remove the tilt rod from the track without adversely affecting the operability of the tilt rod to perform its function in the vertical blind assembly. After the tilt rod 30 is removed from the track 20, the vertical blinds can be assembled.

Referring now to FIGS. 3–6, there is shown several alternative embodiments of tracks and tilt rods. Each of the tracks and tilt rods are of different configurations that demonstrate various styles that are available in the vertical blind industry. The alternative embodiments are examples of different configurations and do not bind the inventor to only these embodiments.

In addition to using different styles of tracks and tilt rods, the dimensions of the track, bridge, or tilt rod may be changed from those shown in the drawings to achieve similar results. Further, the tilt rod may be attached to different parts of the track during the extrusion process. All of the embodiments are particularly adapted to extrude aluminum tracks and tilt rods, but tracks and tilt rods can be extruded from different materials, such as plastics.

For each of the embodiments, the track, bridge, and tilt rod are also all extruded as one solid piece. The bridge 40 is extruded and arranged to be severed to remove the tilt rod from the track without adversely affecting the operability of the tilt rod and tract to perform its function in the vertical blind assembly. When the user desires to fabricate the vertical blinds, the two components must be separated using the custom designed tool discussed above.

It will be recognized by those skilled in the art that changes or modifications may be made to the above-described embodiments without departing from the broad inventive concept of the invention. It should therefore be understood that this invention is not limited to the particular embodiments described herein but is intended to include all changes and modifications that are within the scope and spirit of the invention as set forth in the following claims.

What is claimed is:

1. An extruded component for a vertical blind assembly, comprising:

an extruded track of a vertical blind assembly, the track having a unitary, generally channel-shaped frame with a generally hollow interior;

an extruded vertical blind assembly tilt rod; and an extruded bridge which attaches the tilt rod internally to the track so that the tilt rod is disposed completely within the hollow interior of the track, the bridge being integrally and removably formed between the track and the tilt rod such that upon removal of the tilt rod from the bridge the track retains its unitary, generally channel-shaped frame, said bridge being extruded and arranged to be severed to remove the tilt rod from the track without adversely affecting the operability of the tilt rod to perform its function in the vertical blind assembly wherein upon removal of the tilt rod from the track the vertical blind assembly can be assembled.

2. The extruded component for the vertical blind assembly of claim 1, wherein the track, the tilt rod, and the bridge are extruded from aluminum.

3. The extruded component for the vertical blind assembly of claim 1, wherein the track, the tilt rod, and the bridge are extruded from plastic.

4. The extruded component for the vertical blind assembly of claim 1, wherein the bridge is arranged to be severed from the track without adversely affecting the operability of the track and the tilt rod to perform their functions in the vertical blind assembly.

5. The extruded component for the vertical blind assembly of claim 1, wherein the tilt rod is extruded with a cross-shaped cross-section.

6. The extruded component for the vertical blind assembly of claim 1, wherein the tilt rod is extruded as a circular cross-section with V-notched depressions.

7. The extruded component for the vertical blind assembly of claim 1, wherein the tilt rod is extruded as a circular cross-section with at least two concave depressions.

8. The extruded component for the vertical blind assembly of claim 1, wherein the tilt rod is extruded as a substantially circular cross-section with a concave depression.

9. The extruded component for the vertical blind assembly of claim 1, wherein the tilt rod is extruded with a star-shaped cross-section.

10. The extruded component for the vertical blind assembly of claim 9, wherein the star-shaped cross-section of the tilt rod has eight points.

11. An extruded component for a vertical blind assembly, comprising:

a vertical blind assembly track comprising a longitudinally extended, generally planar web and two longitudinally extended, opposing, parallel walls;

a vertical blind assembly tilt rod; and a bridge, disposed between the walls, which attaches the tilt rod to the track so that the tilt rod is disposed completely between the parallel walls, the bridge being integrally and removably formed between the track and the tilt rod such that upon removal of the tilt rod from the bridge the web remains unitary, said bridge being arranged to be severed to remove the tilt rod from the track without adversely affecting the operability of the tilt rod to perform its function in the vertical blind assembly wherein upon removal of the tilt rod from the track the vertical blind assembly can be assembled.

12. The extruded component for the vertical blind assembly of claim 11, wherein the track, the tilt rod, and the bridge are extruded from aluminum.

13. The extruded component for the vertical blind assembly of claim 11, wherein the track, the tilt rod, and the bridge are extruded from plastic.

14. The extruded component for the vertical blind assembly of claim 11, wherein the bridge is arranged to be severed from the track without adversely affecting the operability of the track and the tilt rod to perform their functions in the vertical blind assembly.

15. The extruded component for the vertical blind assembly of claim 11, wherein the tilt rod is extruded with a cross-shaped cross-section.

16. The extruded component for the vertical blind assembly of claim 11, wherein the tilt rod is extruded as a circular cross-section with V-notched indentations.

17. The extruded component for the vertical blind assembly of claim 11, wherein the tilt rod is extruded as a circular cross-section with at least two concave indentations.

18. The extruded component for the vertical blind assembly of claim 12, wherein the tilt rod is extruded as a substantially circular cross-section with a concave indentation.

19. The extruded component for the vertical blind assembly of claim 11, wherein the tilt rod is extruded with a star-shaped cross-section.

20. The extruded component for the vertical blind assembly of claim 19, wherein the star-shaped cross-section of the tilt rod has eight points.

21. A vertical blind track and tilt rod, prepared by a process comprising the steps of:

(a) extruding a single component including:

a vertical blind assembly track;

a vertical blind assembly tilt rod; and a bridge attaching the tilt rod to the track, arranged to be severed to remove the tilt rod from the track; and (b) severing the bridge to remove the tilt rod from the track, and assembling said tilt rod and track together to form a vertical blind assembly.

22. An extruded component for a vertical blind assembly, comprising:

an extruded track of a vertical blind assembly, the track having a generally channel-shaped frame with a generally hollow interior prior to and after removal of the tilt rod;

an extruded vertical blind assembly tilt rod; and an extruded bridge which attaches the tilt rod internally to the track, said bridge being extruded and arranged to be severed to remove the tilt rod from the track without adversely affecting the operability of the tilt rod to perform its function in the vertical blind assembly wherein upon removal of the tilt rod from the track the vertical blinds can be assembled;

wherein the track, the tilt rod, and the bridge are extruded from plastic.

23. An extruded component for a vertical blind assembly, comprising:

an extruded track of a vertical blind assembly, the track having a generally channel-shaped frame with a generally hollow interior prior to and after removal of the tilt rod;

an extruded vertical blind assembly tilt rod having a cross-shaped cross-section; and an extruded bridge which attaches the tilt rod internally to the track, said bridge being extruded and arranged to be severed to remove the tilt rod from the track without adversely affecting the operability of the tilt rod to perform its function in the vertical blind assembly wherein upon removal of the tilt rod from the track the vertical blinds can be assembled.

24. An extruded component for a vertical blind assembly, comprising:

an extruded track of a vertical blind assembly, the track having a generally channel-shaped frame with a generally hollow interior prior to and after removal of the tilt rod;

an extruded vertical blind assembly tilt rod having a circular cross-section with V-notched depressions; and an extruded bridge which attaches the tilt rod internally to the track, said bridge being extruded and arranged to be severed to remove the tilt rod from the track without adversely affecting the operability of the tilt rod to perform its function in the vertical blind assembly wherein upon removal of the tilt rod from the track the vertical blinds can be assembled.

25. An extruded component for a vertical blind assembly, comprising:

an extruded track of a vertical blind assembly, the track having a generally channel-shaped frame with a generally hollow interior prior to and after removal of the tilt rod;

an extruded vertical blind assembly tilt rod having a circular cross-section with at least two concave depressions; and an extruded bridge which attaches the tilt rod internally to the track, said bridge being extruded and arranged to be severed to remove the tilt rod from the track without adversely affecting the operability of the tilt rod to perform its function in the vertical blind assembly wherein upon removal of the tilt rod from the track the vertical blinds can be assembled.

26. An extruded component for a vertical blind assembly, comprising:

an extruded track of a vertical blind assembly, the track having a generally channel-shaped frame with a generally hollow interior prior to and after removal of the tilt rod;

an extruded vertical blind assembly tilt rod having a substantially circular cross-section with a concave depression; and an extruded bridge which attaches the tilt rod internally to the track, said bridge being extruded and arranged to be severed to remove the tilt rod from the track without adversely affecting the operability of the tilt rod to perform its function in the vertical blind assembly wherein upon removal of the tilt rod from the track the vertical blinds can be assembled.

27. An extruded component for a vertical blind assembly, comprising:

an extruded track of a vertical blind assembly, the track having a generally channel-shaped frame with a generally hollow interior prior to and after removal of the tilt rod;

an extruded vertical blind assembly tilt rod having a star-shaped cross-section; and an extruded bridge which attaches the tilt rod internally to the track, said bridge being extruded and arranged to be severed to remove the tilt rod from the track without adversely affecting the operability of the tilt rod to perform its function in the vertical blind assembly wherein upon removal of the tilt rod from the track the vertical blinds can be assembled.

28. The extruded component for the vertical blind assembly of claim 27, wherein the star-shaped cross-section of the tilt rod has eight points.

29. An extruded component for a vertical blind assembly, comprising:

a generally hollow vertical blind assembly track prior to and after removal of the tilt rod;

a vertical blind assembly tilt rod having a cross-shaped cross-section; and a bridge which attaches the tilt rod internally to the track, said bridge being arranged to be severed to remove the tilt rod from the track without adversely affecting the operability of the tilt rod to perform its function in the vertical blind assembly wherein upon removal of the tilt rod from the track the vertical blinds can be assembled.

30. An extruded component for a vertical blind assembly, comprising:

a generally hollow vertical blind assembly track prior to and after removal of the tilt rod;

a vertical blind assembly tilt rod having a circular cross-section with V-notched indentations; and a bridge which attaches the tilt rod internally to the track, said bridge being arranged to be severed to remove the tilt rod from the track without adversely affecting the operability of the tilt rod to perform its function in the vertical blind assembly wherein upon removal of the tilt rod from the track the vertical blinds can be assembled.

31. An extruded component for a vertical blind assembly, comprising:

a generally hollow vertical blind assembly track prior to and after removal of the tilt rod;

a vertical blind assembly tilt rod having a circular cross-section with at least two concave indentations; and a bridge which attaches the tilt rod internally to the track, said bridge being arranged to be severed to remove the tilt rod from the track without adversely affecting the operability of the tilt rod to perform its function in the vertical blind assembly wherein upon removal of the tilt rod from the track the vertical blinds can be assembled.

32. An extruded component for a vertical blind assembly, comprising:

a generally hollow vertical blind assembly track prior to and after removal of the tilt rod;

a vertical blind assembly tilt rod having a substantially circular cross-section with a concave indentation; and a bridge which attaches the tilt rod internally to the track, said bridge being arranged to be severed to remove the tilt rod from the track without adversely affecting the operability of the tilt rod to perform its function in the vertical blind assembly wherein upon removal of the tilt rod from the track the vertical blinds can be assembled.

33. An extruded component for a vertical blind assembly, comprising:

a generally hollow vertical blind assembly track prior to and after removal of the tilt rod;

a vertical blind assembly tilt rod having a star-shaped cross-section; and a bridge which attaches the tilt rod internally to the track, said bridge being arranged to be severed to remove the tilt rod from the track without adversely affecting the operability of the tilt rod to perform its function in the vertical blind assembly wherein upon removal of the tilt rod from the track the vertical blinds can be assembled.

34. The extruded component for the vertical blind assembly of claim 33, wherein the star shaped cross-section of the tilt rod has eight points.

* * * * *